US006004004A

United States Patent [19]

Altman et al.

[11] Patent Number: 6,004,004

[45] Date of Patent: Dec. 21, 1999

[54] PORTABLE DUAL FLASHLIGHT ASSEMBLY WITH ELONGATED DEFORMABLE BODY MEMBER

[75] Inventors: Peter Altman, Austin, Tex.; Velissa Van Scoyoc, Newtown, Pa.

[73] Assignee: Lumatec Industries, Inc., Austin, Tex.

[21] Appl. No.: 08/756,607

[22] Filed: Nov. 26, 1996

[51] Int. Cl.[6] ..... F21L 7/00

[52] U.S. Cl. ..... 362/191; 362/184; 362/205; 362/421

[58] Field of Search ..... 362/184, 190, 362/191, 197, 198, 202, 205, 208, 285, 396, 388, 421, 419

[56] References Cited

U.S. PATENT DOCUMENTS

| | | | |
|---|---|---|---|
| D. 361,399 | 8/1995 | Carbone et al. | D26/43 |
| D. 364,935 | 12/1995 | de Blois | D26/43 |
| D. 366,948 | 2/1996 | Carbone | D26/43 |
| D. 368,539 | 4/1996 | Carbone et al. | D26/43 |
| 4,739,801 | 4/1988 | Kimura et al. | 138/120 |
| 5,268,826 | 12/1993 | Greene | 362/103 |
| 5,449,206 | 9/1995 | Lockwood | 285/261 |
| 5,521,803 | 5/1996 | Eckert et al. | 362/198 |
| 5,531,625 | 7/1996 | Zhong | 446/120 |
| 5,567,115 | 10/1996 | Carbone | 362/198 |
| 5,702,175 | 12/1997 | Chen | 362/191 |

*Primary Examiner*—Stephen Husar

*Attorney, Agent, or Firm*—Flanagan & Flanagan; John R. Flanagan; John K. Flanagan

[57] ABSTRACT

A portable dual flashlight assembly includes a flexible and deformable elongated body member for wrapping and retaining the assembly around an object, a battery compartment mounted to each end of the body member and providing a source of electrical power at each end thereof, a light bulb enclosure mounted to each battery compartment, a light bulb mounted in each light bulb enclosure and generating a beam of light at one end of each battery compartment and a mechanism associated with each light bulb enclosure for switching each light bulb on and off. The deformable body member includes an elongated deformable member and a flexible tubular covering enclosing the deformable member. The flexible covering extends around and along the deformable member and has a longitudinal central channel receiving the wire therethrough.

29 Claims, 7 Drawing Sheets

PORTABLE DUAL FLASHLIGHT ASSEMBLY WITH ELONGATED DEFORMABLE BODY MEMBER

BACKGROUND OF THE INVENTION

1. Field of the Invention

The present invention generally relates to portable light devices and, more particularly, is concerned with a portable dual flashlight assembly having an elongated bendable twistable deformable body member.

2. Description of the Prior Art

Portable light devices generally provide a source of light in areas where it is not convenient or possible to use a light device powered by a source of electricity such as from an electrical outlet of a home or building. A common type of portable light device, generally known as a "flashlight" is powered by one or more batteries. These devices generally have a light bulb portion at one end connected to an elongated handle portion for housing one or more batteries.

Variations have been developed over the years in the general structure of the common portable flashlight device as described above. One recent variation, sold under the trademark "The Snake" by Black & Decker Inc. of Newark, Del., provides a flexible flashlight having a light bulb at one end, a compartment for one or more batteries at the opposite end and an elongated flexibly deformable handle disposed therebetween having conductor means disposed therein for electrically connecting the light bulb portion with the battery compartment. The deformable handle which apparently employs a flexible assembly of connectors, as disclosed in U.S. Pat. No. 5,449,206 to Lockwood, can be wrapped around an object for retaining the flexible flashlight in a desired position. U.S. design Pat. Nos. identified as Des. 361,399 to Carbone et al, Des. 364,935 to deBlois, Des. 366,948 to Carbone and Des. 368,539 to Carbone et al assigned to Black & Decker Inc. are directed toward flexible flashlight designs.

A problem exists, however, with these prior art portable light devices in that none of them appear to satisfy a need for more than one beam of light in areas where a source of electricity is not readily available and where it is desirable to have a device providing more than one beam of light with each light beam being easily movable in relation to the other light beam. Also, a problem appears to exist particularly with the above-described prior art device having the elongated flexible handle in that the electrical connection which is disposed within the handle is vulnerable to being damaged upon flexing of the handle.

Consequently, a need remains for a portable light device which overcomes the aforementioned problems in the prior art without introducing any new problems in place thereof.

SUMMARY OF THE INVENTION

The present invention provides a portable dual flashlight assembly with a deformable body member which is designed to satisfy the aforementioned need. The dual flashlight assembly of the present invention constitutes a simple and economical solution for furnishing more than one beam of light from a single device to provide better illumination where electricity is not readily available and where it is desirable to have more than one beam of light with each being easily movable in relation to the other. Further, the dual flashlight assembly has clips mounted to its opposite ends to permit clipping the ends to the pants or belt of the user while wrapping the deformable body member of the assembly around the user's body so as to direct the lights forwardly of the user in order to see each side of a path, for example. The portable flashlight assembly also decreases the risk of damage to the electrical connection between the light bulb portion and the battery compartment by placing them adjacent to one another at each end of the assembly so that the connection between them need not extend through the deformable body member thereof.

Accordingly, the present invention is directed to a portable light assembly which comprises: (a) a flexible and deformable elongated body member for wrapping and retaining the assembly around an object; (b) at least one battery compartment providing a source of electrical power and being mounted at one end to one end of the body member; (c) at least one light bulb enclosure mounted to the other end of the battery compartment opposite to the one end thereof; (d) at least one light bulb mounted in the light bulb enclosure for generating a beam of light; and (e) means electrically connecting the light bulb with the battery compartment for switching the light bulb on and off.

Preferably, the portable light assembly includes a battery compartment connected to each of the opposite ends of the elongated deformable body member, a light bulb enclosure with a light bulb mounted therein being electrically connected to each battery compartment at each of the opposite ends of the body member, and a switch mechanism associated with each light bulb enclosure at each of the opposite ends of the body member for switching the respective light bulbs on and off.

More particularly, in one embodiment the elongated deformable body member includes a bendable and twistable elongated wire having a pair of opposite ends and a flexible tubular covering extending along and around the elongated wire from one end to the opposite end thereof. The tubular covering defines a longitudinal channel axially through a center thereof for receiving the elongated wire therethrough. In another embodiment, the elongated deformable body member includes an outer flexible tubular member having a pair of opposite ends and an elongated deformable and flexible vertebrae member made up on a series of ball and socket connector elements and being disposed through the flexible tubular member. More particularly, each connector element has a ball and socket disposed at its opposite ends and being attached in a tandem arrangement with one another such that the ball and socket of a given one connector element is pivotally interfit with the socket and ball of adjacent connector elements disposed at opposite ends of the given one connector element.

The battery compartment includes a housing defining an interior cavity and having a first end connected to one of the ends of the elongated deformable body member and an opposite open second end and one or more batteries disposed within the interior cavity of the battery compartment.

The light bulb enclosure includes a casing defining an interior chamber and having an open first end connected to the open second end of the housing of the battery compartment and having an open second end opposite from the first end, a concave reflector member with a peripheral edge and defining an opening at its center with the reflector member being mounted at the peripheral edge to the second end of the casing, an annular light bulb holding member having a pair of opposite first and second ends with the first end being connected with the reflector member and surrounding the opening therein and the second end extending toward the first end of the casing and defining a cell in alignment with the opening in the reflector member and having a protruding rim on an exterior thereof, and a transparent lens having a peripheral edge and being disposed over and attached at the peripheral edge to the open second end of the casing.

The portable light assembly also comprises a light bulb retainer disposed within the interior chamber of the casing of the light bulb enclosure. The light bulb retainer includes a light bulb support member having a top end, a bottom end, an annular ledge extending from the bottom end, an inverted hook member attached to the annular ledge and extending upwardly therefrom so as to connect with the protruding rim of the annular light bulb holding member of the light bulb enclosure upon insertion of the light bulb support member into the cell of the annular light bulb holding member of the light bulb enclosure, a female socket means disposed in the top end of the light bulb support member for receiving the light bulb and a pair of positive and negative battery contacts with each battery contact being disposed at and attached to the bottom end of the light bulb support member. The positive battery contact is for electrical contact with a positive end of one of the batteries of the battery compartment. The negative battery contact is for electrical contact with a negative end of one of the batteries of the battery compartment.

Furthermore, the battery compartment includes at least one and preferably a pair of contact springs disposed within the interior cavity of the housing and mounted to the first end thereof. A first of the pair of contact springs receives a positive end of one battery while a second contact spring receives a negative end of a second battery. A spring contact plate is also disposed between and is electrically connected to the pair of contact springs. The contact springs and the spring contact plate operate in conjunction with the positive and negative battery contacts of the light bulb retainer to conduct electrical power from the pair of batteries to the female socket means of the light bulb retainer and therefrom to the light bulb upon connection of the light bulb enclosure to the battery compartment.

Finally, the switching means includes a switch plate disposed within the interior chamber of the casing of the light bulb enclosure and attached to the female socket means of the light bulb retainer. The annular ledge of the light bulb support member of the light bulb retainer defines a hole therethrough above a portion of the positive battery contact of the light bulb retainer and below a portion of the switch plate of the switching means such that, upon the light bulb enclosure being fully connected with the battery compartment, the switch plate and the positive battery contact make electrical contact with one another through the hole of the annular ledge so as to conduct electrical power from the positive end of one battery of the battery compartment to the female socket means of the light bulb retainer, whereas upon the light bulb enclosure being less than fully connected with the battery compartment, the switch plate and the positive battery contact do not make electrical contact with one another and therefore do not conduct electrical power to the female socket means of the light bulb retainer.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 2 is a front elevational view of a right light bulb enclosure of the assembly taken along line 2—2 of FIG. 1.

FIG. 3 is a front elevational view of a left light bulb enclosure of the assembly taken along line 3—3 of FIG. 1.

FIG. 24 is a longitudinal sectional view of the positive battery contact taken along line 24—24 of FIG. 23.

DETAILED DESCRIPTION OF THE INVENTION

Figure 1:
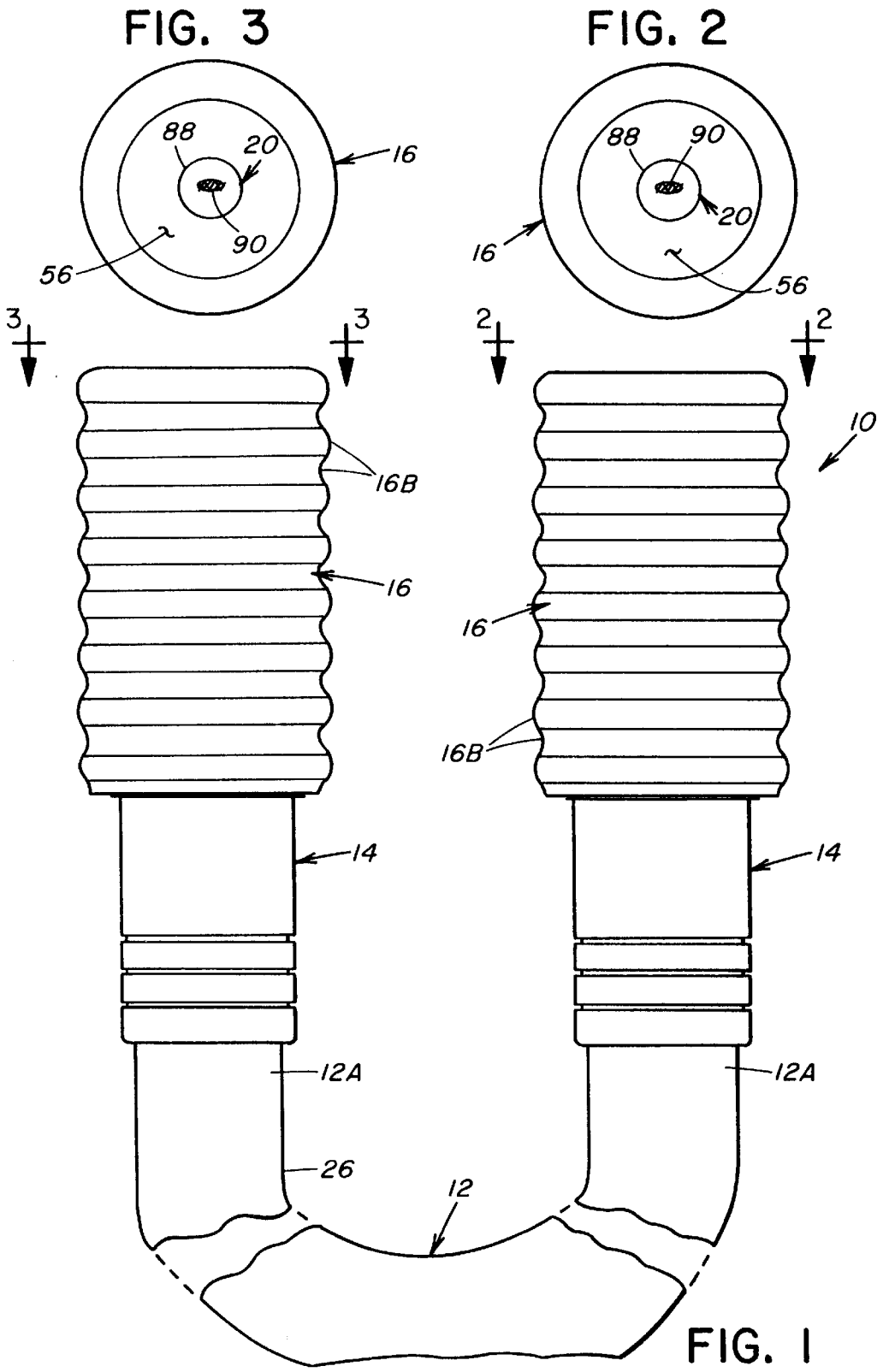
FIG. 1 is a top plan view of a portable dual flashlight assembly of the present invention in an assembled condition but showing a deformable body member thereof in foreshortened form.
Figure 6:
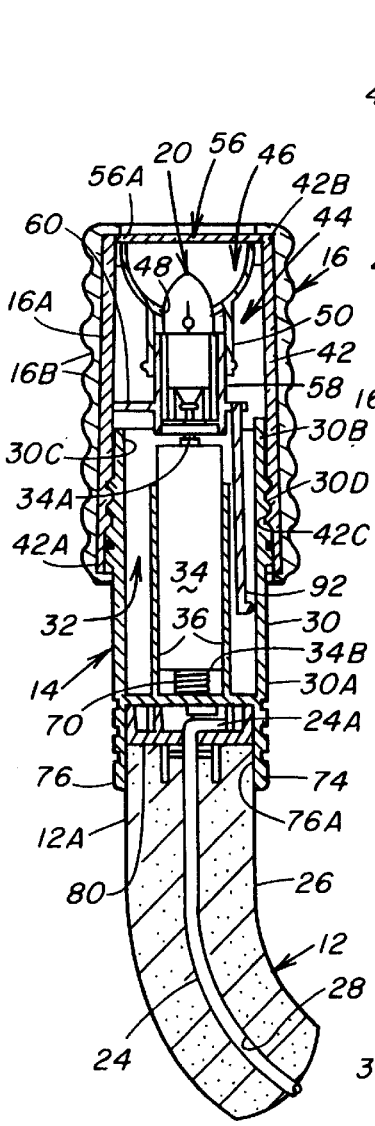
FIG. 6 is a longitudinal sectional view of one end of the assembly in the assembled condition.
Figure 5:
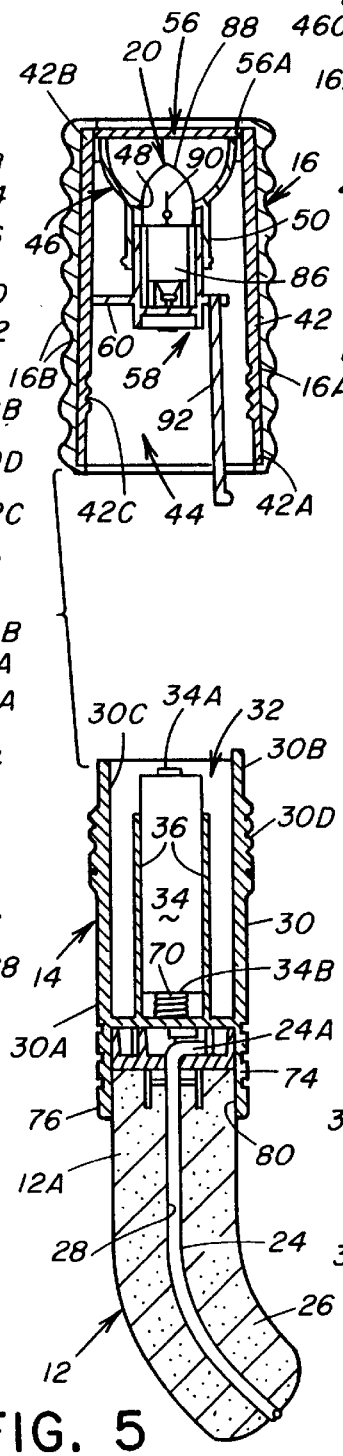
FIG. 5 is a longitudinal sectional view of one end of the assembly in an intermediate condition in the process of being assembled from the condition shown in FIG. 4 to the condition shown in FIG. 6.
Figure 4:
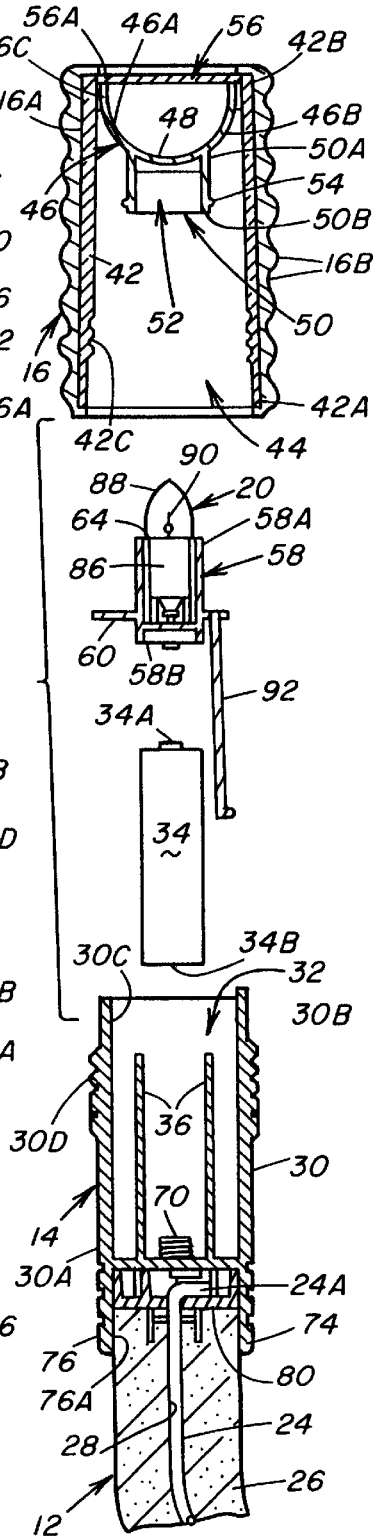
FIG. 4 is an exploded longitudinal sectional view of one end of the assembly shown in a disassembled condition.
Figure 9:
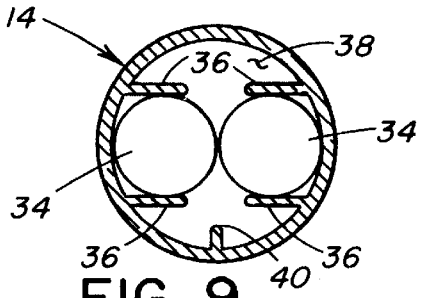
FIG. 9 is a transverse sectional view of the assembly taken along line 9—9 of FIG. 7.
Figure 10:
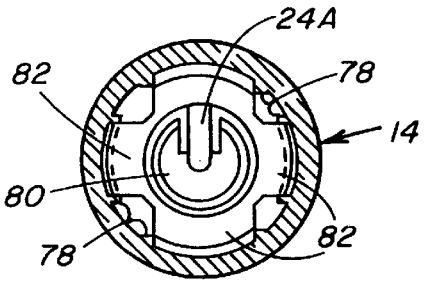
FIG. 10 is a transverse sectional view of the assembly taken along line 10—10 of FIG. 8.
Figure 7:
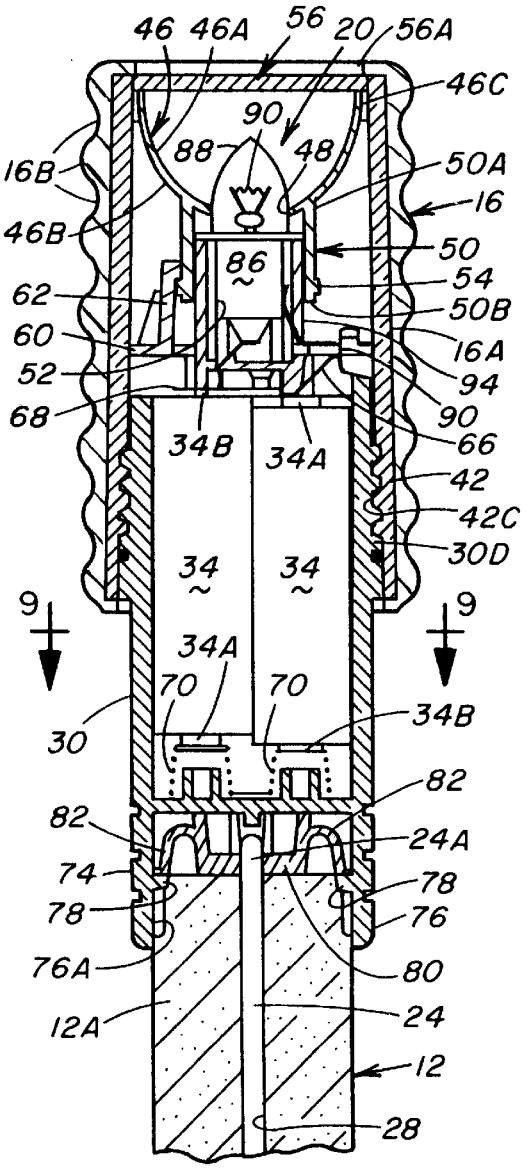
FIG. 7 is a longitudinal sectional view of one end of the assembly showing the light bulb enclosure only partially threadably mated with a battery compartment of the assembly.
Figure 8:
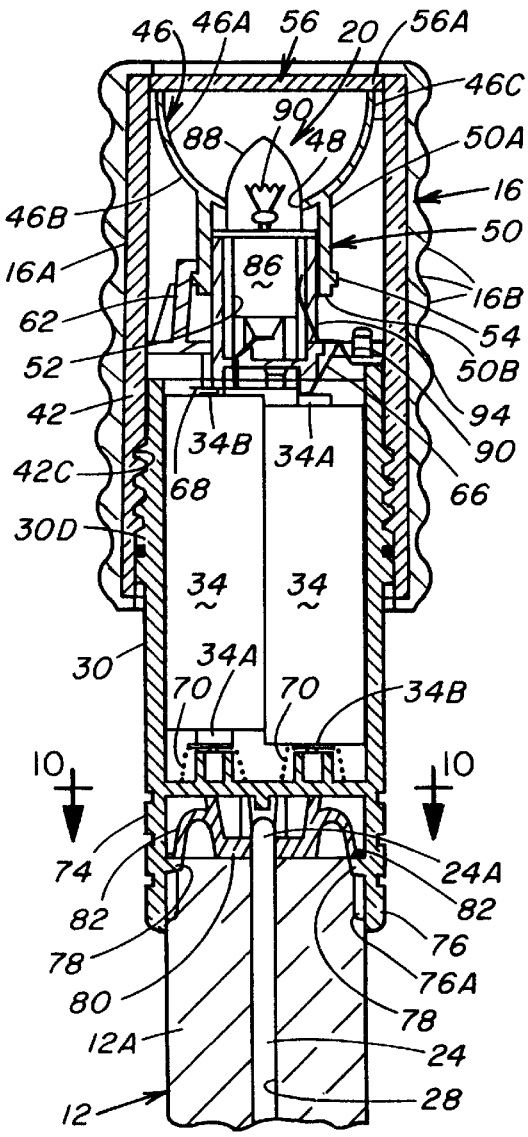
FIG. 8 is a longitudinal sectional view of one end of the assembly showing the light bulb enclosure fully threadably mated with the battery compartment of the assembly.
Figure 18:
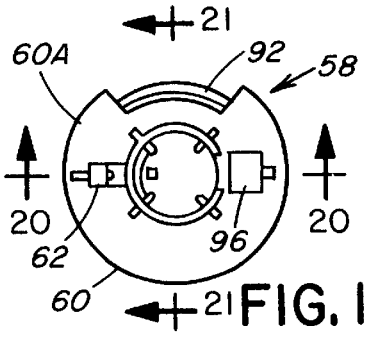
FIG. 18 is a top plan view of the light bulb support member as seen along line 18—18 of FIG. 17.
Figure 21:
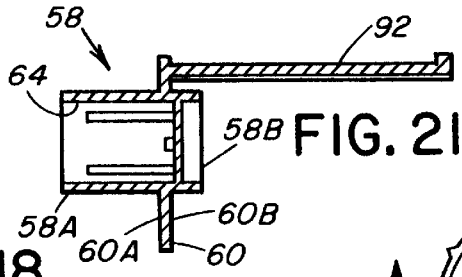
FIG. 21 is another longitudinal sectional view of the light bulb support member taken along line 21—21 of FIG. 18.
Figure 12:
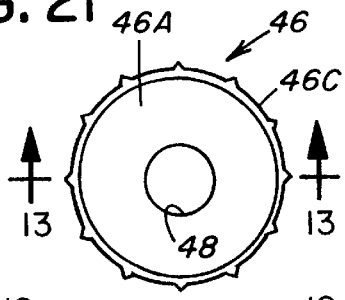
FIG. 12 is a top plan view of the reflector member and holding member as seen along line 12—12 of FIG. 11.
Figure 17:
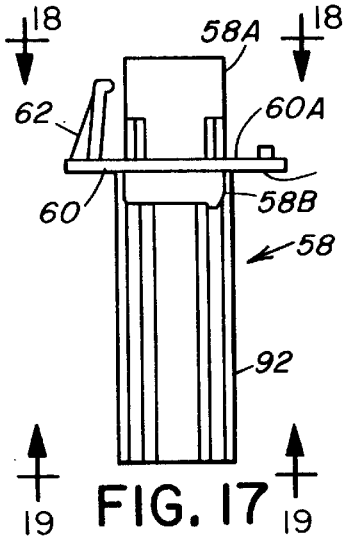
FIG. 17 is a side elevational view of a light bulb support member of a light bulb retainer of the assembly.
Figure 20:
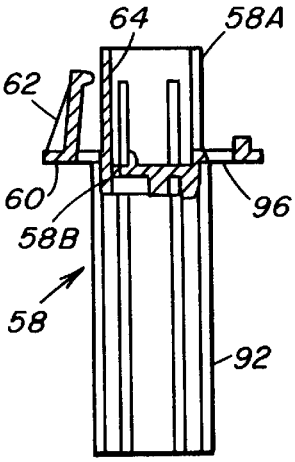
FIG. 20 is a longitudinal sectional view of the light bulb support member taken along line 20—20 of FIG. 18.
Figure 11:
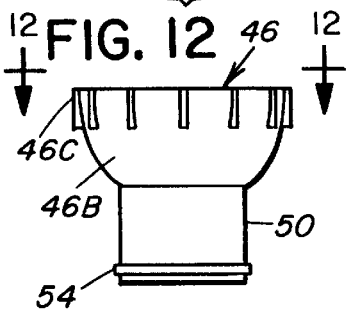
FIG. 11 is a side elevational view of a concave reflector member and light bulb holding member of the light bulb enclosure.
Figure 19:
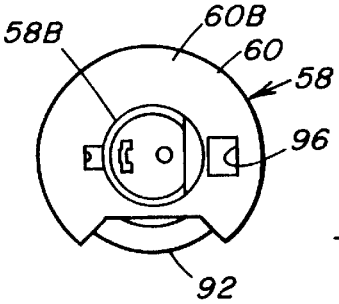
FIG. 19 is a bottom plan view of the light bulb support member as seen along line 19—19 of FIG. 17.
Figure 15:
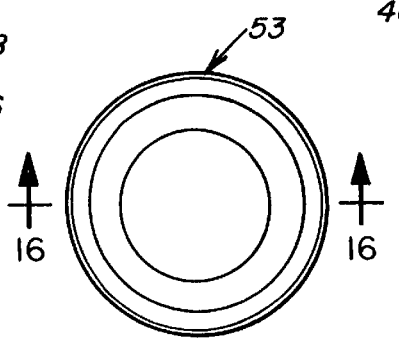
FIG. 15 is a top plan view of the liner as seen along line 15—15 of FIG. 14.
Figure 13:
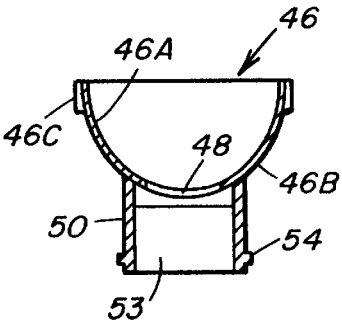
FIG. 13 is a longitudinal sectional view of the reflector member and holding member taken along line 13—13 of FIG. 12.
Figure 16:
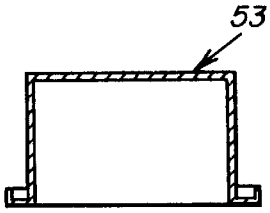
FIG. 16 is a longitudinal sectional view of the liner taken along line 16—16 of FIG. 15.
Figure 14:
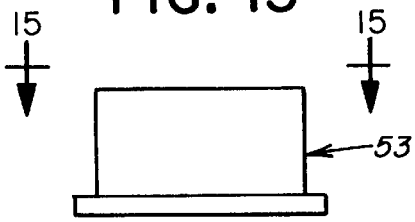
FIG. 14 is a side elevational view of a liner for the light bulb holding member of FIG. 11.
Figure 29:
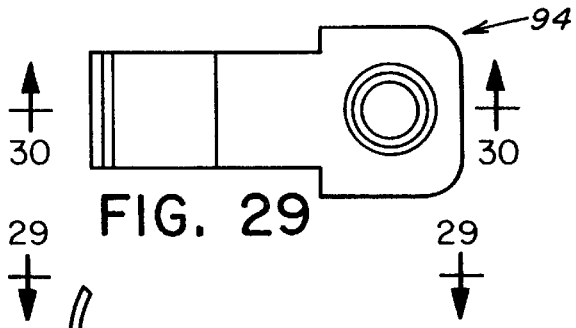
FIG. 29 is a top plan view of the switch plate as seen along line 29—29 of FIG. 28.
Figure 30:
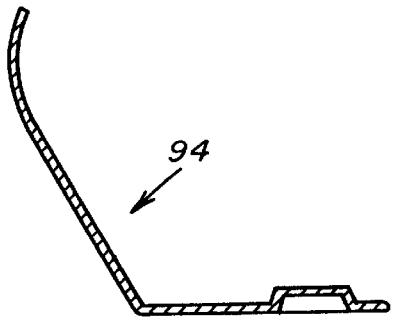
FIG. 30 is a longitudinal sectional view of the switch plate taken along line 30—30 of FIG. 29.
Figure 28:
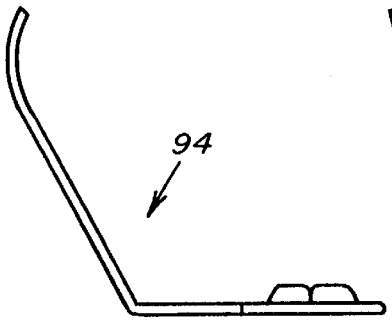
FIG. 28 is a side elevational view of a switch plate of a switching mechanism of the assembly.
Figure 24:
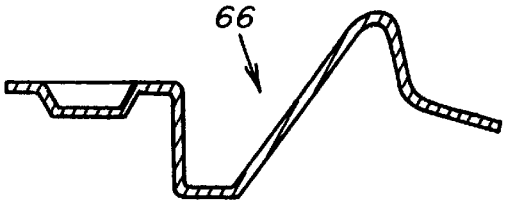
FIG. 24 is a longitudinal sectional view of the contact as seen along line 23—23 of FIG. 22.
Figure 27:
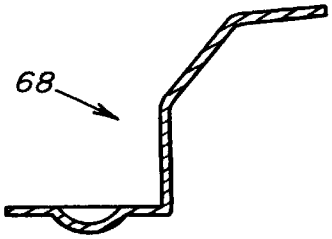
FIG. 27 is a longitudinal sectional view of the negative battery contact taken along line 27—27 of FIG. 26.
Figure 22:
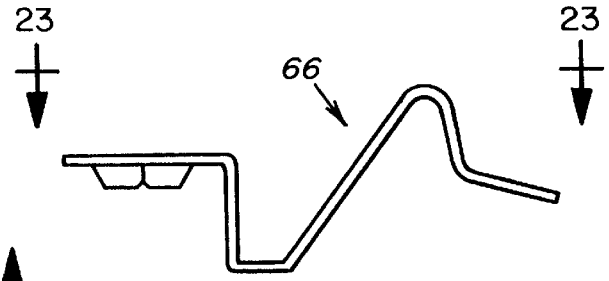
FIG. 22 is a side elevational view of a positive battery contact of the light bulb retainer.
Figure 26:
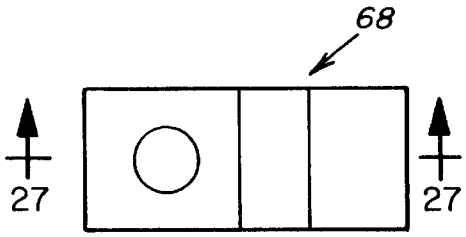
FIG. 26 is a top plan view of the negative battery contact as seen along line 26—26 of FIG. 25.
Figure 25:
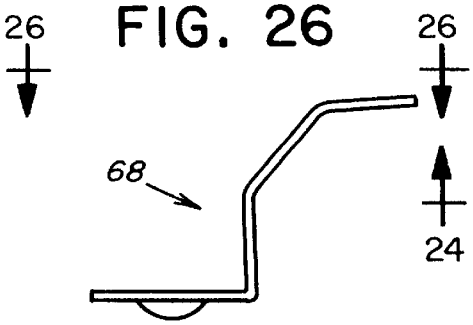
FIG. 25 is a side elevational view of a negative battery contact of the light bulb retainer.
Figure 23:
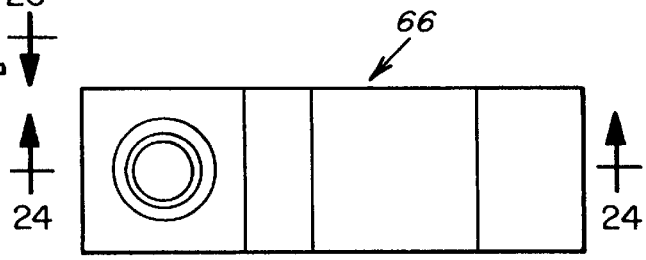
FIG. 23 is a top plan view of the positive battery contact as seen along line 23—23 of FIG. 22.
Figure 31C:
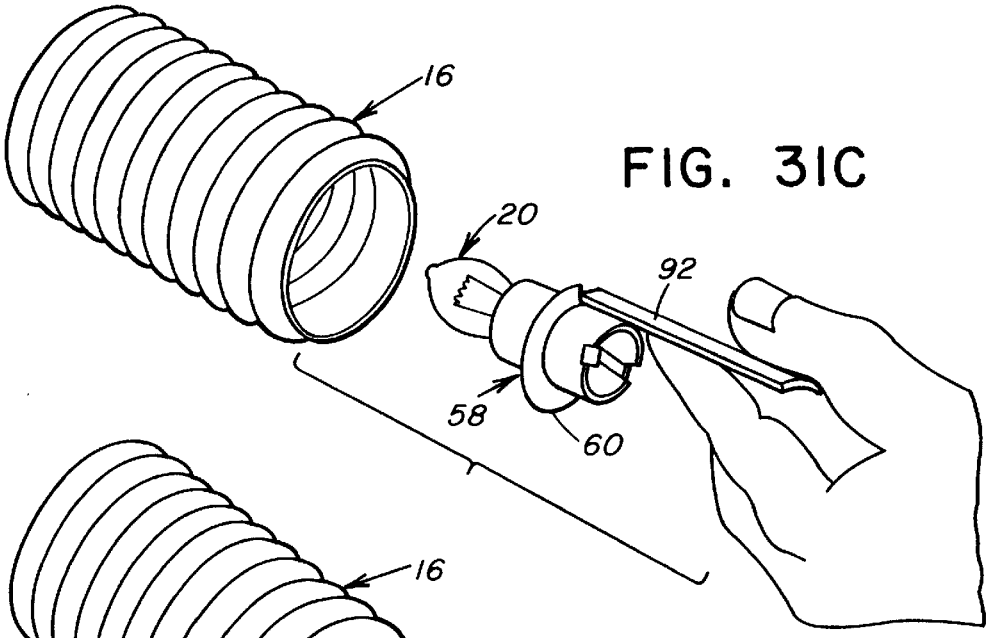
FIGS. 31A, 31B and 31C are series of perspective views showing steps in the process of replacing a light bulb on the light bulb retainer and into the light bulb enclosure of the assembly and securing the light bulb enclosure to the battery compartment of the assembly.
Figure 31B:
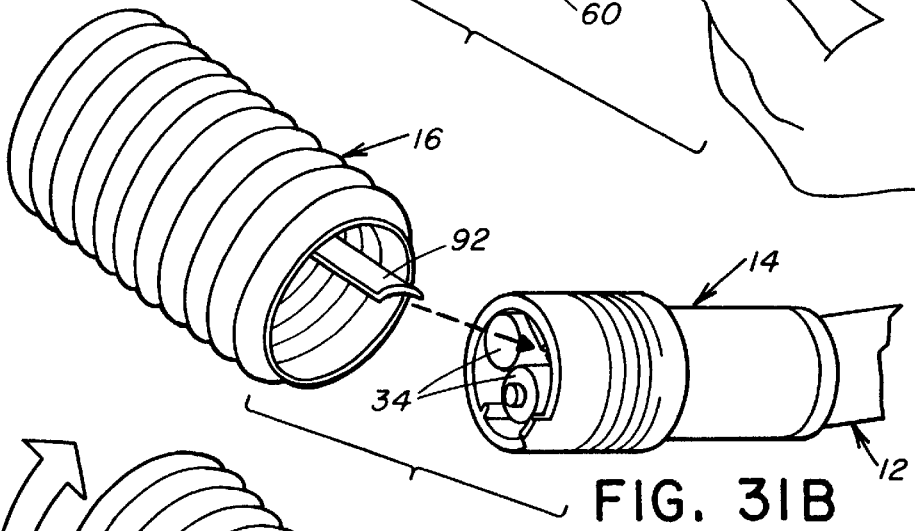
Figure 31A:
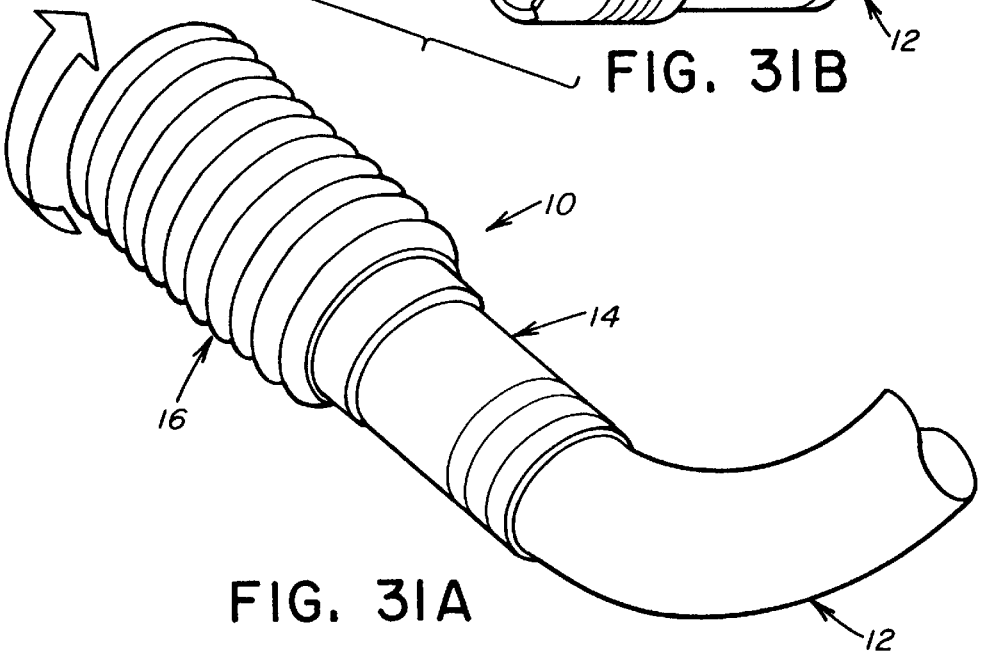

Referring to the drawings and particularly to FIGS. 1 to 6, there is illustrated a portable dual flashlight assembly, generally designated 10, of the present invention. The portable dual flashlight assembly 10 basically includes a flexible and deformable elongated body member 12 being bendable and twistable for wrapping and retaining the assembly 10 around an object, at least one and preferably a pair of battery compartments 14 each mounted to one of the opposite ends 12A of the body member 12, at least one and preferably a pair of light bulb enclosures 16 each mounted to one of the battery compartments 14, at least one and preferably a pair of light bulb retainers 18 each mounted to one of the light bulb enclosures 16 and having a light bulb 20 mounted therein which generate beams of light at the respective opposite ends of the body member 12, and a switching mechanism 22 associated with each light bulb enclosure 16 for separately switching the respective light bulbs 20 on and off.

Referring to FIGS. 1 and 4–6, a first embodiment of the elongated body member 12 of the light assembly 10 includes a deformable, that is bendable and twistable, elongated rod or wire 24 having a pair of opposite ends 24A and a flexible tubular covering 26 extending along and around the elongated wire 24 between the opposite ends 24A thereof. The tubular covering 26 has a longitudinal channel 28 defined along a central axis thereof for receiving the elongated wire 24 therethrough. The elongated wire 24 is comprised substantially of copper and can be comprised of any other suitable deformable material which when bent or twisted will retain that shape. The tubular covering 26 is preferably cylindrical in shape and comprised of a foam material although it can be comprised of any other suitable flexible material. The elongated wire 24 and the covering 26 can be of any desired length. The diameter of the tubular covering 26 is slightly less than that of the battery compartment 14 for insertion therein.

Figure 32:
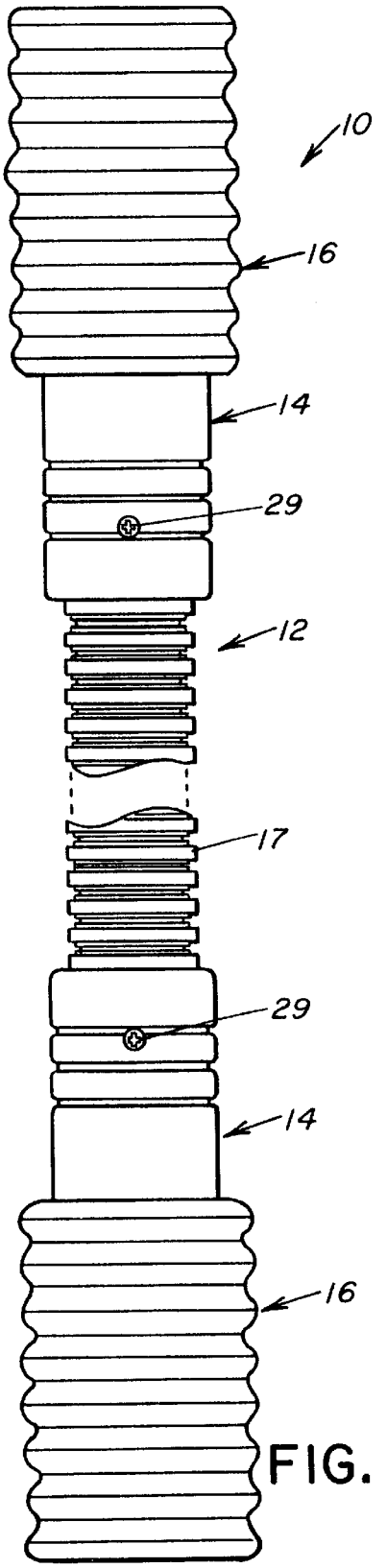
FIG. 32 is a top plan view of the portable dual flashlight assembly of the present invention in an assembled condition but showing a second embodiment of the deformable body member thereof in foreshortened form.
Figure 33:
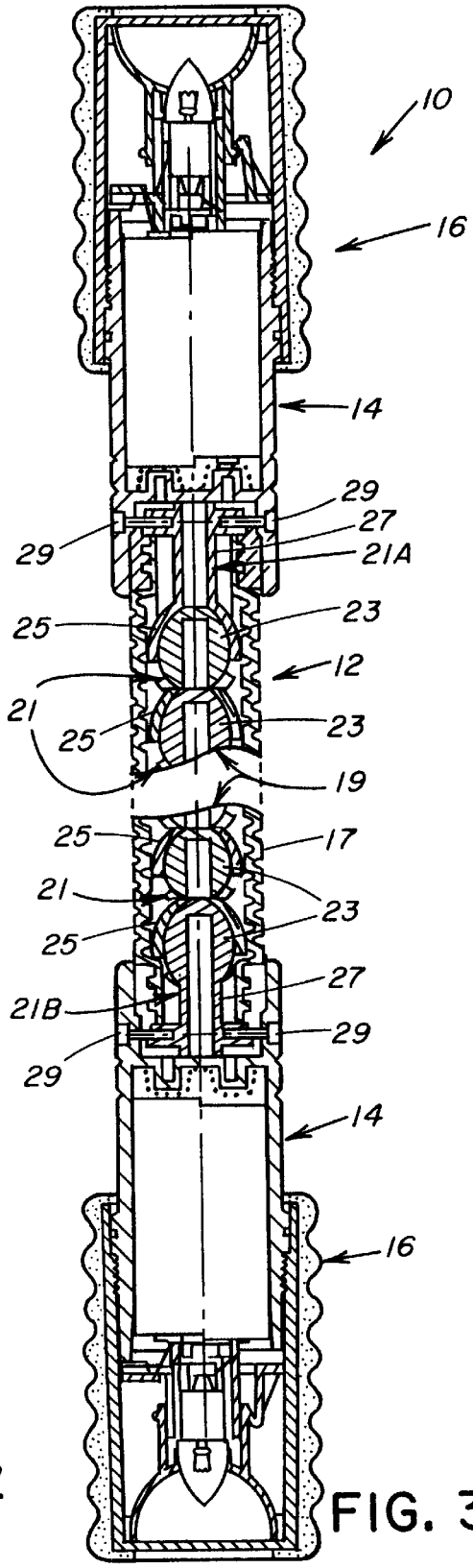
FIG. 33 is a longitudinal foreshorted sectional view of the light assembly in the assembled condition showing the second embodiment of the elongated deformable body member of the assembly.

Referring to FIGS. 32 and 33, a second, and more preferred, embodiment of the elongated deformable body member 12 of the light assembly 10 includes an outer flexible tubular member 17 having a pair of opposite ends and an elongated deformable and flexible vertebrae member 19 made up on a series of ball and socket connector elements 21 and being disposed through the flexible tubular member 17. More particularly, each connector element 21 has a ball 23 and socket 25 disposed at its opposite ends and being attached in a tandem arrangement with one another such that the ball 23 and socket 25 of a given one connector element 21 (except the end connector elements 21A, 21B at the opposite ends of the vertebrae member 19) is pivotally interfitted with the socket 25 and ball 23 of adjacent connector elements 21 disposed at opposite ends of the given one connector element 21. The end connector elements 21A, 21B respectively have a ball 23 and shaft 27 and a socket 25 and a shaft 27. The shafts 27 are provided to receive screws 29 to attached the opposite ends of the vertebrae member 27 and of the tubular member 17 to the respective battery compartments 14.

Referring now to FIGS. 1 and 4 to 10, each battery compartment 14 of the assembly 10 includes a hollow housing 30 defining an interior cavity 32 and having a first end 30A connected to one of the ends of the elongated deformable body member 12 and an open second end 30B opposite from the first end 30A, and one or more batteries 34 disposed within the interior cavity 32 of the battery compartment 14. Each battery 34 has a pair of opposite positive and negative ends 34A, 34B and is preferably is AA in size but can be designed for other suitable sizes. The housing 30 of each battery compartment 14 is generally cylindrical in shape and comprised of a substantially rigid material. As best in FIGS. 4–9, the housing 30 is large enough in diameter to hold a pair of the batteries 34.

Preferably, the housing 30 of each battery compartment 14 includes two opposing and facing pairs of spaced apart parallel ribs 36 attached to and extending longitudinally along an interior surface 30C of the housing 30 within the interior cavity 32. Each pair of spaced ribs 36 receives one battery 34 therebetween. The two opposing and facing pairs of ribs 36, in the preferred embodiment, define an adjacent longitudinal canal 38 extending longitudinally within the interior cavity 32 of the housing 30. The relation of the canal 38 to other components of the assembly 10 is described below. The housing 30 of each battery compartment 14 further includes a protrusion 40 opposite from the canal 38 and extending longitudinally along the interior surface 30C of the housing 30 within the interior cavity 32. The relation of the protrusion 40 to other components of the assembly 10 is also described below.

Referring now to FIGS. 1 to 8 and 11 to 16, each light bulb enclosure 16 of the assembly 10 includes a hollow casing 42 defining an interior chamber 44 and having an open first end 42A connected to the open second end 30B of the housing 30 of the respective one battery compartment 14 and having an open second end 42B opposite from the first end 42A. Each light bulb enclosure 16 also includes a concave-shaped reflector member 46 having top and bottom surfaces 46A, 46B, an outer or top peripheral edge 46C and an inner or bottom opening 48 defined at a center thereof. The reflector member 46 is mounted at its peripheral edge 46C to the open second end 42B of the casing 42 such that the top surface 46A of the reflector member 46 faces in the direction of the open second end 42B of the casing 42.

Each light bulb enclosure 16 further includes an annular light bulb holding member 50 having a pair of opposite first and second ends 50A, 50B with the first end 50A being integrally connected with the bottom surface 46B of the reflector member 46 and surrounding the opening 48 therein and the second end 50B extending toward the first end 42A of the casing 42 and defining a hollow cell 52 aligned with the opening 48 in the reflector member 46. Each light bulb holding member 50 also has a liner 53 fitted therein and an outward protruding rim 54 formed on the second end 50B thereof.

Still further, each light bulb enclosure 16 includes a transparent lens 56 having a peripheral edge 56A and being disposed over and attached at the peripheral edge 56A to the open second end 42B of the casing 42. Each light bulb enclosure 16 and the lens 56 thereof are respectively generally cylindrical and circular in shape. Each light bulb enclosure 16 is comprised of a substantially rigid material and has a diameter slightly greater than that of the respective battery compartment 14 for allowing the light bulb enclosure 16 to fit over the open second end 30B of the housing 30 of the respective battery compartment 14.

Each light bulb enclosure 16 also has an external surface 16A formed into a series of undulations 16B which provide a gripping surface for a user. The second end 30B of the housing 30 of the battery compartment 14 includes an externally threaded surface 30D. The first end 42A of the casing 42 of the light bulb enclosure 16 includes an internally threaded surface 42C for threadably mating with the externally threaded surface 30D of the battery compartment 14 when the light bulb enclosure 16 is fitted thereover.

Referring now to FIGS. 4 to 8 and 17 to 27, each light bulb retainer 18 of the assembly 10 is disposed within the interior chamber 44 of the casing 42 of a respective one of the light bulb enclosures 16. Each light bulb retainer 18 includes a light bulb support member 58 having a top end 58A, a bottom end 58B and an annular ledge 60 attached to and extending outward from an exterior surface of the bottom end 58B. The annular ledge 60 of each light bulb support member 58 has a top surface 60A and a bottom surface 60B. Each light bulb support member 58 also has an inverted hook member 62 attached to the top surface 60A of the annular ledge 60 and extending upwardly therefrom so as to releasably connect with the protruding rim 54 of the annular light bulb holding member 50 upon insertion of the light bulb support member 58 into the cell 52 of the annular light bulb holding member 50 of the light bulb enclosure 16.

Further, each light bulb support member 58 has a female socket means 64 disposed in the top end 58A of the light bulb support member 58, and a pair of positive and negative battery contacts 66, 68 disposed at and attached to the bottom end 58B of the light bulb support member 58. The positive battery contact 66 is for making electrical contact with the positive end 34A of one of the batteries 34 of the battery compartment 14 while the negative battery contact 68 is for making electrical contact with the negative end 34B of the other one of the batteries 34 of the battery compartment 14.

Referring now particularly to FIGS. 4 to 8 and 22 to 27, each battery compartment 14 of the assembly 10 also includes at least one contact spring 70 and preferably a pair of contact springs 70 disposed within the interior cavity 32 of the housing 30 thereof and mounted to the first end 30A of the housing 30. If one contact spring 70 is present, it receives the negative end 34B of one battery 34 and an elongated contact member (not shown) would extend from the one contact spring 70 through the interior cavity 32 of the housing 30 to the negative battery contact 68 of the light bulb retainer 18. The contact spring 70 and the elongated contact member operate in conjunction with the positive and negative battery contacts 66, 68 of the light bulb retainer 18 to conduct electrical power from the one battery 34 to the female socket means 64 of the light bulb retainer 18 upon connection of each light bulb enclosure 16 to the respective battery compartment 14.

However, each battery compartment 14 preferably includes a pair of the contact springs 70 disposed within the interior cavity 32 of the housing 30 and mounted to the first end 30A thereof. A first of the pair of contact springs 70 receives a positive end 34A of one battery 34 while a second contact spring 70 receives a negative end 34B of a second battery 23. A spring contact plate 72 is also disposed between and is electrically connected to the pair of contact springs 70. The contact springs 70 and the spring contact plate 72 operate in conjunction with the positive and negative battery contacts 66, 68 of the light bulb retainer 18 to conduct electrical power from the pair of batteries 34 to the female socket means 64 of the light bulb retainer 18 upon connection of the light bulb enclosure 16 to the battery compartment 14.

Referring again to FIGS. 4 to 10, each battery compartment 14 of the assembly 10 also includes an annular extension portion 74 extending from the first end 30A of the housing 30 in a direction opposite from the open second end 30B of the housing 30 and defining a receptacle 76 receiving and connecting with one of the ends 24A of the elongated wire 24 of the body member 12 for mounting the respective battery compartment 14 to the one end of the body member 12. The annular extension portion 74 has a plurality of protruded knobs 78 on an interior surface 76A within the receptacle 76 thereof. Each end 24A of the elongated wire 24 of the body member 12 that is connected to an annular extension portion 74 of a respective battery compartments 14 has a lock plate 80 attached thereto with a pair of opposite elastic feet 82 extending therefrom. The elastic feet 82 snap-lock the lock plate 80 to the plurality of protruded knobs 78 for connection of the body member 12 to the extension portion 74 of the respective battery compartment 14. A pair of opposite guide rails 84 are attached to the interior surface 76A of the receptacle 76 below the knobs 78 for positioning of the lock plate 80 within the receptacle 76.

Referring now to FIGS. 4 to 8 and 31, each light bulb 20 of the assembly 10 has opposite first and second ends and includes a male socket means 86 at the first end for mateable insertion into the female socket means 64 of the light bulb retainer 18. The female socket means 64 of the light bulb retainer 18 has an internally threaded surface 64A and the male socket means 86 of the light bulb 20 has an externally threaded surface 86A adapted to threadably mate with the internally threaded surface 64A of the female socket means 64. Each light bulb 20 also has a lamp 88 at the second end thereof for insertion through the cell 52 of the light bulb holding member 50 and therefrom through the opening 48 of the reflector member 46 of the light bulb enclosure 16 for disposition between the reflector member 46 and the transparent lens 56 of the light bulb enclosure 16. The lamp 88 provides illumination in the form of a beam of light upon reception of electrical power conducted from the one or more batteries 34 of the battery compartment 14 to the battery contacts 66, 68 of the light bulb retainter 18 and therefrom to the female socket means 64 of the light bulb retainer 18 and onto the male socket means 86 of the light bulb 20 and finally to filaments 90 of the lamp 88.

Referring now particularly to FIGS. 4 to 6, 9, 17 to 21 and 31A–31C, the light bulb support member 58 of the light bulb retainer 18 has an elongated tongue-shaped member 92 attached to the annular ledge 60 and extending away from the bottom end 58B of the light bulb support member 58 for gripping by the user to facilitate the removal and replacement of the light bulb support member and with it the light bulb 20 and for insertion into the canal 38 of the respective battery compartment 14 in the process of reassembling the light bulb support member 58 into the light bulb holding member 50. The protrusion 40 on the interior surface 30C of the housing 30 being located opposite from the canal 38 prevents insertion of the elongated tongue-shaped member 92 on the wrong side of the pairs of ribs 36 of the respective battery compartment 14.

Referring now particularly to FIGS. 7, 8 and 28 to 30, each switching mechanism 22 of the assembly 10 includes a switch plate 94 disposed within the interior chamber 44 of the casing 42 of the light bulb enclosure 16 and attached to the female socket means 64 of the light bulb retainer 18. The annular ledge 60 of the light bulb support member 58 of the light bulb retainer 18 defines a hole 96 therethrough above a portion of the positive battery contact 66 of the light bulb retainer 18 and below a portion of the switch plate 94 of the switching mechanism 22 such that, upon each light bulb enclosure 16 being fully screwed downward on and connected with the respective battery compartment 14, the switch plate 94 and the positive battery contact 66 make electrical contact with one another through the hole 96 of the annular ledge 60 so as to conduct electrical power from the positive end 34A of one battery 34 of the battery compartment 14 to the female socket means 64 of the light bulb retainer 18 causing the lamp 88 to turn on and provide illumination in the form of a beam of light. However, upon the light bulb enclosure 16 being less than fully screwed down on and connected with the respective battery compartment 14, the switch plate 94 and the positive battery contact 66 do not make electrical contact with one another and therefore do not conduct electrical power to the female socket means 64 of the light bulb retainer 18 which results in the lamp 88 remaining off and providing no illumination.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A portable light assembly, comprising:

(a) a flexible and deformable elongated body member having a pair of opposite ends and being adapted for wrapping and retaining said assembly around an object;

(b) a battery compartment for providing a source of electrical power and being mounted to one of said opposite ends of said body member, said battery compartment including (i) a housing defining an interior cavity and having a first end connected to said one end of said body member and an open second end opposite from said first end, and (ii) at least one battery disposed within said interior cavity of said battery compartment, said battery having a pair of negative and positive ends;

(c) a light bulb enclosure mounted to said battery compartment, said light bulb enclosure including (i) a casing defining an interior chamber and having an open first end connected to said open second end of said housing of said battery compartment and having an open second end opposite from said first end, (ii) a reflector member having top and bottom surfaces with a peripheral edge and an opening defined at a center thereof, said reflector member being disposed within said interior chamber of said casing and mounted at said peripheral edge to said open second end of said casing, said top surface of said reflector member facing in the direction of said open second end of said casing, (iii) an annular light bulb holding member having a pair of opposite first and second ends, said first end being connected with said bottom surface of said reflector member and surrounding said opening therein, said second end extending toward said first end of said casing and defining a cell in alignment with said opening in said reflector member and having a protruding rim on an exterior surface of said second end, and (iv) a transparent lens having a peripheral edge, said lens being disposed over and attached at said peripheral edge thereof to said open second end of said casing;

(d) a light bulb mounted in said light bulb enclosure for generating a beam of light; and (e) means electrically connecting said light bulb with said battery compartment for switching said light bulb on and off.

2. The assembly of claim 1 further comprising:

at least one light bulb retainer disposed within said interior chamber of said casing, said light bulb retainer including (i) a light bulb support member having a top end and a bottom end, (ii) a female socket means defined in said top end of said light bulb support member, and (iii) positive and negative battery contacts disposed at and attached to said bottom end of said light bulb support member for making electrical contact with said positive and negative ends of said battery in said battery compartment.

3. The assembly of claim 2 wherein said light bulb includes:

a male socket means defined at a first end of said light bulb for mateable insertion into said female socket means of said light bulb support member of said light bulb retainer; and a lamp at a second end of said light bulb for insertion through said cell of said light bulb holding member and through said opening of said reflector member of said light bulb enclosure for disposition between said reflector member and said transparent lens of said light bulb enclosure to provide a beam of light upon actuating said means for switching said light bulb on.

4. The assembly of claim 3 wherein said female socket means of said light bulb retainer has an internally threaded surface.

5. The assembly of claim 4 wherein said male socket means of said light bulb has an externally threaded surface for threadably mating with said internally threaded surface of said female socket means.

6. The assembly of claim 2 wherein said light bulb support member includes:

an annular ledge extending outwardly from an exterior surface of said bottom end of said light bulb support member; and an inverted hook member attached to said annular ledge and extending upwardly therefrom so as to releasably connect with said protruding rim of said annular light bulb holding member of said light bulb enclosure upon insertion of said light bulb support member into said cell of said annular light bulb holding member.

7. The assembly of claim 6 wherein said battery compartment has a pair of spaced apart parallel ribs extending longitudinally along an interior surface of said housing and within said interior cavity of said housing, said pair of ribs being for receiving said battery therebetween.

8. The assembly of claim 7 wherein said pair of ribs define an adjacent longitudinal canal extending longitudinally within said interior cavity of said housing.

9. The assembly of claim 8 wherein said light bulb support member of said light bulb retainer has an elongated tongue-shaped member attached to said annular ledge and extending away from said bottom end of said light bulb support member for gripping by a user to facilitate removal and replacement of said light bulb support member from and to said cell of said light bulb holding member to replace said light bulb, said tongueshaped member being insertable into said canal of said battery compartment to assemble light bulb enclosure to said battery compartment.

10. The assembly of claim 9 wherein said battery compartment has a protrusion opposite from said canal and extending longitudinally along said interior surface of said housing of said battery compartment within said interior cavity of said housing so as to prevent insertion of said elongated tongue-shaped member of said light bulb support member on a wrong side of said ribs of said battery compartment.

11. The assembly of claim 1 wherein said battery compartment has an externally threaded surface at said open second end of said housing.

12. The assembly of claim 11 wherein said interior chamber of said casing of said light bulb enclosure has an internally threaded surface at said first end thereof for threadably mating with said externally threaded surface of said battery compartment.

13. The assembly of claim 6 wherein said switching means includes a switch plate disposed within said interior chamber of said casing of said light bulb enclosure and attached to said female socket means of said light bulb retainer.

14. The assembly of claim 13 wherein said annular ledge of said light bulb support member of said light bulb retainer defines a hole therethrough above a portion of said positive battery contact thereof and below a portion of said switch plate of said switching means such that, upon said light bulb enclosure being fully connected with said battery compartment, said switch plate and said positive battery contact make electrical contact with one another through said hole of said annular ledge so as to conduct electrical power from said battery in said battery compartment to said female socket means of said light bulb retainer causing said light bulb to turn on and provide illumination in the form of a beam of light, whereas upon said light bulb enclosure being less than fully connected with said battery compartment, said switch plate and said positive battery contact do not to make electrical contact with one another and therefore do not conduct electrical power to said female socket means of said light bulb retainer causing said light bulb to remain on and not provide illumination.

15. A portable light assembly, comprising:

(a) a flexible and deformable elongated body member having a pair of opposite ends and being adapted for wrapping and retaining said assembly around an object;

(b) a battery compartment for providing a source of electrical power and being mounted to one of said opposite ends of said body member, said battery compartment including (i) a housing defining an interior cavity and having a first end connected to said one end of said body member and an open second end opposite from said first end, and (ii) at least one battery disposed within said interior cavity of said battery compartment, said battery having a pair of negative and positive ends;

(c) a light bulb enclosure mounted to said battery compartment;

(d) at least one light bulb retainer disposed within said light bulb enclosure, said light bulb retainer including (i) a light bulb support member having a top end and a bottom end, (ii) a female socket means defined in said top end of said light bulb support member, and (iii) positive and negative battery contacts disposed at and attached to said bottom end of said light bulb support member for making electrical contact with said positive and negative ends of said battery in said battery compartment;

(e) a light bulb for generating a beam of light, said light bulb having male socket means mateably inserted into said female socket means in said light bulb support member of said light bulb retainer; and (f) means electrically connecting said light bulb with said battery compartment for switching said light bulb on and off.

16. The assembly of claim 15 wherein said battery compartment has a contact spring disposed within said interior cavity of said housing and mounted to said first end of said housing, said contact spring being for receiving an end of said battery, and an elongated contact member extending from said contact spring through said interior cavity of said housing to one of said battery contacts of said light bulb retainer.

17. The assembly of claim 16 wherein said contact spring and said elongated contact member of said battery compartment operate in conjunction with said positive and negative battery contacts of said light bulb retainer to conduct electrical power from said battery to said female socket means of said light bulb retainer upon connection of said light bulb enclosure to said battery compartment.

18. The assembly of claim 15 wherein said battery compartment receives a pair of said batteries and has a pair of contact springs disposed within said interior cavity and mounted to said first end of said housing of said battery compartment, a first of said pair of contact springs being for receiving a positive end of a first of said pair of batteries and a second of said pair of contact springs being for receiving a negative end of a second of said pair of batteries, and a spring contact plate disposed between and being electrically connected to said pair of contact springs.

19. The assembly of claim 18 wherein said pair of contact springs and said spring contact plate of said battery compartment operate in conjunction with said positive and negative battery contacts of said light bulb retainer to conduct electrical power from said first and second batteries to said female socket means of said light bulb retainer upon connection of said light bulb enclosure to said battery compartment.

20. The assembly of claim 15 wherein said battery compartment has an annular extension portion extending from said first end of said housing thereof in a direction opposite from said open second end of said housing and defining a receptacle for receiving and connecting with said one of said ends of said body member.

21. The assembly of claim 20 wherein said annular extension portion of said battery compartment has a plurality of protruded knobs on an interior surface within said receptacle thereof.

22. The assembly of claim 21 wherein said one end of said body member has a lock plate attached thereto with a pair of opposite elastic feet extending therefrom, said elastic feet being adapted for snap-locking said lock plate to said plurality of protruded knobs for connection of said one end of said body member to said extension portion of said battery compartment.

23. A portable light assembly, comprising:

(a) a flexible and deformable elongated body member having a pair of opposite ends and being adapted for wrapping and retaining said assembly around an object;

(b) a pair of battery compartments, each of said battery compartments being mounted to one of said opposite ends of said body member for providing a source of electrical power at each of said opposite ends of said body member;

(c) a pair of light bulb enclosures, each of said light bulb enclosures being mounted to one of said battery compartments at said opposite ends of said body member;

(d) a pair of light bulbs, each of said light bulbs being mounted in one of said light bulb enclosures at said opposite ends of said body member, each of said light bulbs for generating a beam of light; and (e) a pair of switch mechanisms, each of said switch mechanisms electrically connecting one of said light bulbs with one of said battery compartment at a corresponding one of said opposite ends of said body member and being actuatable for switching said one light bulb on and off.

24. The assembly of claim 23 wherein said body member includes an elongated element having a pair of opposite ends, said elongated element being bendable and twistable for wrapping and retaining said assembly around an object.

25. The assembly of claim 24 wherein each of said battery compartments includes:

a housing defining an interior cavity and having a first end connected to one of said opposite ends of said elongated element of said body member and an open second end opposite from said first end, each of said light bulb enclosures being mounted to said open second end of said housing of one of said battery compartments, each of said light bulbs being mounted in one of said light bulb enclosures for generating a beam of light; and at least one battery disposed within said interior cavity of said housing, said battery having a pair of opposite positive and negative ends and providing a source of electrical power.

26. The assembly of claim 24 wherein said elongated element of said body member is a metallic wire.

27. The assembly of claim 24 wherein said body member further includes a flexible tubular covering extending along and around said elongated element between said opposite ends thereof and defining a longitudinal channel along a center thereof for receiving said elongated element therethrough.

28. The assembly of claim 24 wherein said elongated deformable body member includes an outer flexible tubular member having a pair of opposite ends.

29. The assembly of claim 24 wherein said elongated element of said body member is a deformable and flexible vertebrae member made up on a series of ball and socket connector elements, each connector element having a ball and socket disposed at its opposite ends and being attached in a tandem arrangement with one another such that said ball and socket of a given one connector element is pivotally interfit with said socket and ball of adjacent connector elements disposed at opposite ends of the given one connector element.

* * * * *